United States Patent [19]

Sowards

[11] 3,977,090

[45] Aug. 31, 1976

[54] FIXED-BED VAPOR/SOLIDS CONTACTING DEVICE

[75] Inventor: Donald Maurice Sowards, Claymont, Del.

[73] Assignee: E. I. Du Pont de Nemours and Company, Wilmington, Del.

[22] Filed: Jan. 27, 1975

[21] Appl. No.: 544,311

[52] U.S. Cl. ..... 34/9; 34/95

[51] Int. Cl.[2] ..... F26B 3/00

[58] Field of Search ..... 34/9, 95; 165/9.1

[56] References Cited

UNITED STATES PATENTS 3,803,724 4/1974 Bombich ..... 34/9

OTHER PUBLICATIONS

Pp. 1179–1184 and pp. 1249 and 1250 of "Industrial and Engineering Chemistry", June 1949, Authors Epgun and Orning.

*Primary Examiner*—John J. Camby

[57] ABSTRACT

The efficiency of fixed-bed vapor/solids contacting towers operating on a mass transfer-limiting basis is optimized if the relationship among the structural and operating parameters of the tower, $$\frac{E^2S^2L\Delta P}{V^2}$$

falls within the limits of from 1 to 100. The relationship is applicable to operations with non-condensing vapor systems at flow velocities of up to 35 m/sec. and bed depths of 0.03 to 3.5 meters.

6 Claims, 1 Drawing Figure

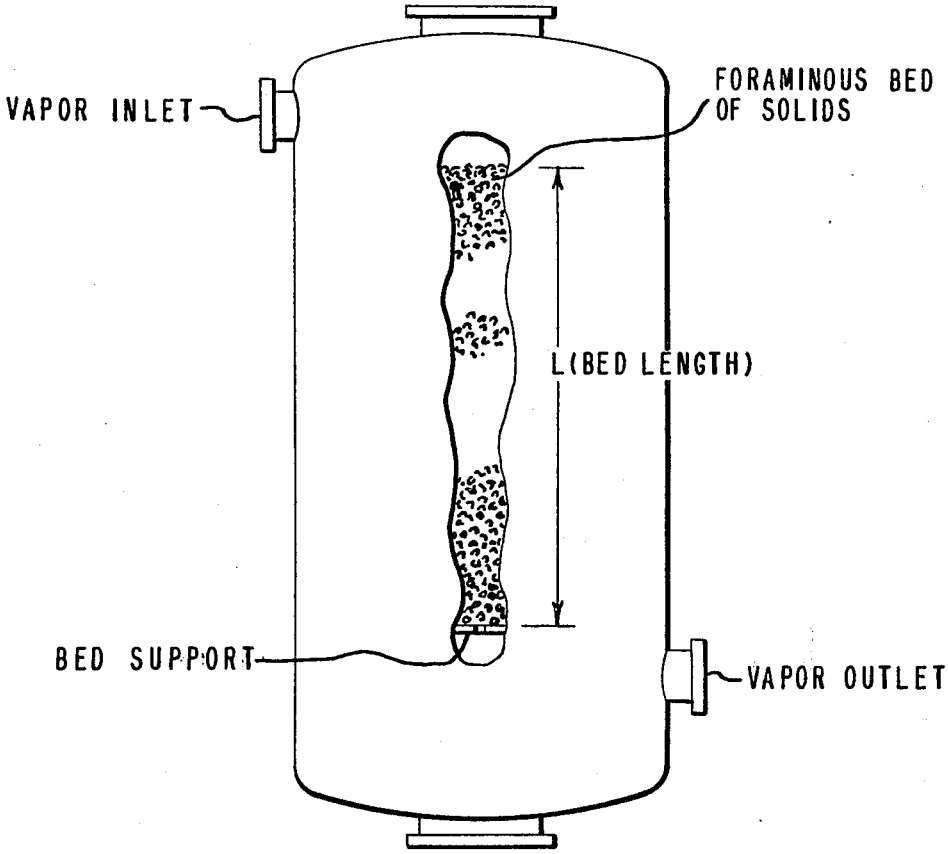
VAPOR INLET
FORAMINOUS BED OF SOLIDS
L(BED LENGTH)
BED SUPPORT
VAPOR OUTLET

FIXED-BED VAPOR/SOLIDS CONTACTING DEVICE

BACKGROUND OF THE INVENTION

The invention is directed to a device for contacting vapors with solids and particularly to vessels having a stationary foraminous bed of solids as the solids contacting medium.

A particularly important aspect of the broad subject of contacting vapors with solids is the design and operation of packed towers, i.e. vessels, usually vertical cylinders, containing packing materials to assure and to facilitate contact between vaporous feeds to such vessels and solids contained therein. The use of packed towers to effect intimate contact between vapors and solids is quite widespread for a vast number of operations such as non-catalytically reacting gases with solids, transferring heat between vapor and solid phases and, of course, for effecting a wide variety of catalytic reactions of the vapor phase.

All of the above-named operations involve problems of gas phase mass transfer in which (1) the gas molecules must be diffused from the bulk of the fluid phase (here we are dealing only with vapors) to the external geometric solid surface, (2) interact with the surface and then (3) be rediffused from the surface to the bulk fluid phase. The more complicated and also the more common instance of this particular operation is the heterogeneous catalysis of the reaction of vapors, which involves the following mechanism:

a. diffusion of a vapor molecule from the bulk of the vapor phase to the catalytic surfaces of the solids, which frequently are intraporous as well as exterior;

b. adsorption onto such catalytic surfaces;

c. reaction of the adsorbed species with the catalytic surface or with a pre-adsorbed reactant species thereon;

d. desorption of the gas molecule from the cataytic surface; and e. rediffusion from the catalytic surfaces back into the bulk of the vapor phase.

The manner and speed with which these steps take place is controlled by factors such as the fluid dynamics, the properties of the catalyst, difference between the properties of the fluid reactant and the products of the reaction, adsorption and desorption energy requirements, activation energy of the catalytic surface and thermal factors such as temperature and heat transfer characteristics.

In view of the complexity of such systems, the design of fixed bed catalytic reactors has frequently been wasteful in that they were overdesigned and therefore were operated at low efficiencies much of the time, especially under operating conditions in which the mass transfer rate was primarily limiting efficiency, i.e. steps (*a*) and (*e*) above.

SUMMARY OF THE INVENTION

The invention is therefore directed to an apparatus for contacting non-condensing vapors with the surface of solids contained in a fixed foraminous bed within a process vessel having vapor inlet and outlet means at opposite ends of the bed at vapor flow rates such that the vapor velocity (V) is 0.1–35 m/sec. characterized in that the relationship $$\frac{E^2S^2L\Delta P}{V^2}$$

is at least 1 but not more than 100, wherein E is the void volume fraction of the bed which is from 0.3 to 0.98; S is the apparent external geometric surface area of the foraminous solids which is from 0.15 to 5.0 $m^2$/liter; and L is the length (depth) of the bed in the direction of vapor flow which is from 0.03 to 3.5 meters.

DEFINITIONS AND ABBREVIATIONS

As used hereinbelow, unless expressly modified or otherwise limited, the below-listed terms have the following meanings:

"Foraminous bed" refers to a fixed bed of solids having interstitial macro spaces as paths through which vapor can be passed irrespective of the microporosity of the particle surface. The solids may be either constrained particulate or monolithic in structure.

"Fixed bed" means a dense bed of solids in which each particulate or monolithic structure rests upon another at essentially the bulk of density of the solids. The bed is essentially free of any relative motion among the structures constituting the bed.

"Non-condensing vapors" refer to vapors, including gases, which at the operating conditions of a given vapor/solids contacting process undergo essentially no condensation to form a fluid-like liquid phase. The term does not, however, exclude liquid aerosols which appear to act like true vapors when they are being contacted with solid surfaces.

"Vapor velocity" refers to the superficial velocity of vaporous feed to the apparatus of the invention. In effect, vapor velocity is the theoretical linear velocity of the vapors through the contacting tower at the process condition of temperature, pressure and mass flow rate calculated without reference to obstructions in the path of flow. Dimensions of the term are meters/sec.

"Void volume fraction" means the ratio of the volume of the interstitial spaces of the foramina of the contacting solids to the total volume of the bed of solids. The intraparticulate pore volume, i.e. the internal micropore volume, is not considered in this concept.

"Surface Area" means the ratio of the apparent or geometric surface area of the contacting solids to the total volume of the bed of solids. Dimensions of the term are meters$^2$/liter.

"Bed Length" means the depth or length of the bed of contacting solids measured along the superficial axis of gas flow through the bed. Dimensions of the term are in meters.

"Monolithic solid structures" within the context of the invention refers to rigid shaped solids having fluid flow paths therethrough which are stacked to obtain a pre-arranged pattern of flow. Examples of monolithic contacting solids are honeycomb catalyst supports, opencell ceramic foam bricks and especially designed structures comprising random or ordered packing of fibrous elements.

"Pressure drop" refers to the drop in pressure of a vapor stream flowing through the catalyst bed and measured across the entire depth of the catalyst bed.

To simplify the specification and claims and to reduce the length thereof the following abbreviations may be used.

| | |
|---|---|
| meter(s) | m |
| second(s) | sec |
| vapor velocity | V (m/sec) |
| void volume fraction | E |
| surface area | S ($m^2$/liter) |
| bed length | L (cm or m) |
| pressure drop | $\Delta$ P (kg/$m^2$) |

DETAILED DESCRIPTION OF THE INVENTION

The invention is directed to apparatus for contacting essentially non-condensing vapors with foraminous solids for various purposes. Interestingly, it has been found that the parameters of the invention are virtually independent of or only secondarily related to the particular purposes of the apparatus. In other words, it has been found that in mass transfer-limited vapor-solid contacting, the efficiency of the contacting is essentially independent of the nature of the physical of chemical phenomenon taking place at the solid surface. For this reason, the invention may be used for a wide variety of different operations using a wide variety of configurations for the apparatus.

Typically, the invention is carried out in a downflow contacting tower of the type shown in the Drawing which consists of a single FIGURE. Referring now to the Drawing, the tower is comprised of an upright closed cylindrical vessel having an upright closed cylindrical vessel having an upper vapor inlet and a lower vapor outlet in the side of the vessel located respectively above and below a bed of foraminous solids which rests upon a rigid bed support.

Thus, while reference is made to contacting "towers", it will be apparent to those skilled in the art that the invention is not restricted to vertical towers, but is applicable to any system in which vapors are passed through a bed of solids, e.g. an horizontal pipe reactor. Basically, the contacting apparatus is comprised of a vessel or conduit having a fixed bed of solids confined therein by means of one or more bed supports, inlet means for passing vapors into the contacting bed and exit means for discharging the contacted gases from the opposite end of the bed. The cross-sectional shape of the vessel is not critical, though ordinarily it will be more economical to use cylindrical vessels. Likewise, it is not necessary that the cross-sectional area be uniform. Nevertheless, a uniform cross-section will be encountered most frequently.

The invention is useful for treating vapors generally so long as they do not condense to form a continuous liquid phase on the solids at the prevailing conditions of operation. Though the invention is not generally applicable to condensing vapor systems, nevertheless it can be used for contacting liquid aerosols with solids since such dispersions tend to act as true vapors and the minute liquid particles therein do not effect any significant change in the macro void volume and surface area of the bed. Materials of construction for both the vessel and the contacting bed will be varied according to the particular corrosion and operating characteristics of the process in which the apparatus is used.

As mentioned hereinabove, both particulate and monolithic contacting solids (packing) may be used in the invention. Among the suitable particulate solids are extrudates (usually cylinders), round beads, irregularly shaped mineral, glass or ceramic particles, fiber bundles, Berl and Intalox saddles, Raschig rings, Lessing rings, cross-partition rings, spiral-type rings, grid packing and wire mesh. Monolithic packings of interest include especially ceramic honeycomb structures such as Torvex ceramic honeycomb which is a cellular structure of alpha alumina or mullite which is available in blocks up to 12 inches square having ½ to 1½ inches thickness. The channels in such honeycombs are available commercially in a variety of shapes and sizes including circular, triangular, square, hexagonal, rectangular and oval channel shapes and channel diameters of about 1 mm to over 5 mm. Monolithic supports of this kind are stacked in place to form a contacting bed of desired thickness.

Regardless of which type of contacting solid is used, the void volume fraction (E) of the resulting bed must be from about 0.3 to about 0.98. Below about 0.3 pressure drop becomes excessive at practical operating flow rates and above 0.98 the structures are mechanically too weak. A most practical and therefore a preferred range of void volume for pelleted structures is 0.4 to 0.6. On the other hand, for monolithic structures a void volume of 0.5 to 0.75 is preferred. For packed fibrous elements, 0.6 to 0.9 is preferred.

The surface area (S) of the contacting solids, excluding microsurface area, can theoretically be from 0.15 to 5 $m^2$/liter. Nevertheless, only areas from about 0.5 to 3 $m^2$/liter have been found to be practical. On the whole, higher contacting efficiencies are obtained if the surface area is from about 0.5 to 2.0.

Within the foregoing limitation as to properties of the contacting solids, the concepts of the invention have been shown to apply to bed depths of as little as 0.03 m and to at least 3.5 m. The invention can also comprise multi-bed contacting systems using the sme or different contacting materials. The invention also encompasses both multibeds and contacting beds in excess of 3.5 m in which cases the invention is defined by determination of the relationship $$\frac{E^2S^2L\Delta P}{V^2}$$

on each of a plurality of increments of the contacting bed(s).

The invention will be more clearly understood by reference to the examples hereinbelow.

EXPERIMENTAL PROCEDURE

The effectiveness of the invention was determined by an extensive series of tests in which vapor/solid contacting efficiency was measured under a wide variety of operating conditions. It will be recognized by those skilled in the art that virtually any vapor/solids contacting device can be used to measure contacting efficiency for a given reaction and that the results obtained upon one type of packing are readily extrapolated to another type of packing providing the reaction is essentially the same. Moreover, if the particular reaction is unencumbered by secondary effects, i.e. if it is limited solely by gas phase mass transfer, then the results may validly be extrapolated to other gas phase mass transfer-limited systems even though such other systems are unalike chemically or physically. For example, contacting efficiencies observed in heat transfer studies can be used to design vapor/solids contacting systems such as packed scrubbing towers and fixed bed catalytic reactors. An appropriate system for such study can be characterized as follows:

1. the reactants and products are all vaporous within the range of conditions to be studied;
2. the amounts of reactants and products are readily measurable;
3. the reactions take place at the catalyst surface, not within the gas phase;
4. small differences in process conditions must produce measurable differences in reaction products; and
5. the reaction is irreversible.

A reaction system fully meeting the above requirements is the vapor phase oxidation of toluene with gaseous oxygen contained in a nitrogen carrier in contact with a supported platinum catalyst at 350°C. and atmospheric pressure.

Two types of reactor test units were prepared each comprised of a two inch I.D. stainless steel tube having ports at each end for inserting thermocouples and for obtaining gas samples. In one type of tube was placed a close-fitting solid plug of monolithic packing and in the other was placed a particulate solid packing enclosed by a metal screen basket. Both of the tubes were sealed around the periphery of the solid beds with temperature-resistant glass wool to avoid by-passing of vapors around the bed.

Piping and connections for the test units were made of stainless steel.

Catalyst efficiency was defined as the weight ratio of component (toluene) reacted to the component supplied times 100. Thus to determine catalyst efficiency for the above-described toluene oxidation reaction, it was necessary to determine the composition of both the feed and product gases. This was done by means of a gas chromatograph utilizing a 5A molecular sieve chromatography column in conjunction with a Beckman Model 402 flame ionization detector for toluene and a F & M Scientific Co. thermal conductivity detector. Gas flows were determined by conventional hydrostatic gas flow meters and pressure drops were measured by means of a mercury or oil manometer. Experience with the test apparatus revealed that the extent of reaction could equally well be determined from chromatographic analysis of the quantity of water or carbon dioxide produced as well as the amount of toluene consumed. From this it is apparent that essentially no intermediate products were formed.

EXAMPLE 1

A block of mullite honeycomb with 3.17 mm diameter cells oriented straight through its 2.5 cm thickness was coated with platinum/alumina catalyst. Analysis showed 0.3 wt. percent platinum which was located within the 0.15 mm thick coating on the cell surfaces. This material had channel surface area (S) of 0.880 $m^2/l$ and a void fraction (E) of 0.61.

Various numbers of 2.5 cm thick layers, about 5 cm in diameter, were packed into the reactor and exposed to air flow containing 1200 ppm (Volume) toluene at various catalyst inlet temperatures. It was found that a 10 cm deep bed operating at a gas flow rate of 80,000 reciprocal hours (80,000/hrs) space velocity exhibited toluene conversions to carbon dioxide and water, corresponding to the gas phase mass transfer characteristic of the honeycomb support at all operating temperatures above 250°C. Data from this system at various flow rates and 350°C., at which toluene conversion is the measure of mass transfer characteristics (Contacting Efficiency), are shown in Table I. Thus, under such conditions, contacting efficiency (Percent) becomes identical with catalyst efficiency as described hereinabove.

TABLE 1

E = 0.61 S = 0.880 $m^2$/liter

| L, cm | V, m/sec | ΔP, kg/m² | $E^2S^2L\ \Delta P/V^2$ | Contacting Efficiency |
|---|---|---|---|---|
| 5.08 | 2.38 | 3.9 | 1.01 | 71 |
| 10.1 | 3.28 | 8.8 | 2.5 | 92 |
| 10.1 | 4.64 | 14.7 | 2.04 | 82 |
| 12.7 | 7.42 | 32.2 | 2.1 | 85 |
| 12.7 | 4.64 | 16.6 | 2.8 | 89 |
| 12.7 | 2.32 | 7.24 | 4.9 | 95 |
| 15.2 | 6.85 | 43.0 | 4.0 | 95 |
| 15.2 | 8.1 | 42.6 | 2.8 | 85 |
| 15.2 | 4.46 | 21.1 | 4.7 | 92.5 |

EXAMPLE 2

An alumina crossflow honeycomb with intersecting cells was formed from layers of cells that alternately intersect in a 90° angle. The hemi-hexagonal channels in each layer which form the cells have a base dimension of 0.267 cm. Test pieces were cut from this material in such a way that the individual channel axis was at a 45° angle to the front surface of the piece. This structure had a void fraction E = 0.75 and a surface area of S = 0.617 $m^2$/liter. Data for this support, using the catalyst coating and operating conditions of Example 1, are shown in Table 2.

TABLE 2

E = 0.75 S = 0.617 $m^2$/liter

| L, cm | V, m/sec | ΔP, kg/m² | $E^2S^2L\ \Delta P/V^2$ | Contacting Efficiency |
|---|---|---|---|---|
| 5.08 | 4.65 | 22.1 | 1.11 | 79 |
| 10.1 | 4.65 | 45.5 | 4.58 | 95 |
| 15.2 | 4.65 | 80.0 | 12.0 | 97 |

EXAMPLE 3

Catalyst layers, 2.54 cm thick, of the structure of Example 1 were packed alternately with 2.54 cm thick layers of the catalyst structure of Example 2. Data for operation according to Example 1 are shown in Table 3.

Weighted average values according to fractional volume were used for E and S. Thus, E = 0.5 (0.6) + 0.5 (0.75) = 0.68 and S = 0.5 (0.88) + 0.5 (0.617) = 0.75 $m^2$/liter.

TABLE 3

E = 0.68 S = 0.75 $m^2$/liter

| L, cm | V, m/sec | ΔP, kg/m² | $E^2S^2L\ \Delta P/V^2$ | Contacting Efficiency |
|---|---|---|---|---|
| 5.08 | 2.38 | 9.47 | 2.2 | 84 |
| 10.1 | 4.64 | 48.4 | 5.8 | 92 |
| 15.2 | 6.9 | 137. | 11.3 | 93 |

EXAMPLE 4

A cordierite honeycomb with triangular cells, approximately 14.5 cells per 2.54 cm, was used in this example. This structure had a void fraction E = 0.6 and a surface area of 2.28 $m^2$/liter. The data for this support, using the catalyst coating and operating conditions of Example 1 are shown in Table 4.

TABLE 4

| E = 0.6 S = 2.28 m²/liter | | | | |
|---|---|---|---|---|
| L, cm | V, m/sec | ΔP, kg/m² | $E^2S^2L\ \Delta P/V^2$ | Contacting Efficiency |
| 2.54 | 4.63 | 18.0 | 3.98 | 69 |
| 2.54 | 7.4 | 30.7 | 2.66 | 59 |
| 5.08 | 2.02 | 14.3 | 33.3 | 95 |
| 5.08 | 4.63 | 33.0 | 14.6 | 87 |
| 5.08 | 7.4 | 51.8 | 9.45 | 78 |

Because of the triangular shape of the channel, the hydrodynamic diameter of this material is significantly different than the geometric diameter of the cell. Consequently, it is preferred to correct the values of E and S to compensate for this factor. This was done in accordance with the procedure described in Kirk & Othmer, *Encyclopedia of Chemical Technology*, 2d. Ed., J. Wiley & Son, N.Y., Vol. 9, p. 445 ff.

Using the above-referred procedure, the hydrodynamic diameter is 4 (cell area/cell perimeter). Thus, the properties of the structure based on this become E = 0.29 and S = 1.11 m²/liter. The results amended to account for the hydrodynamic diameter were as follows:

| | | | | | |
|---|---|---|---|---|---|
| $E^2S^2L\Delta P/V^2$ | 0.4 | 0.3 | 3.3 | 1.5 | 1.0 |
| Contacting Efficiency | 69 | 59 | 95 | 87 | 78 |

EXAMPLE 5

A particulate catalyst packing was prepared using wads of ceramic yarn coated with 0.1 weight percent platinum catalyst. The yarn strand contained 50 fibers (0.002 cm diameter). Thus the effective surface area used was that of the yarn strand rather than the sum of the individual fibers. Accordingly, the void within the yarn strand was considered not to contribute to contacting efficiency. Thus, E = 0.98 and S = 0.635 m²/liter. For operation similar to that of Example 1, data are presented in Table 5.

TABLE 5

| E = 0.98 S = 0.635 m²/liter | | | | |
|---|---|---|---|---|
| L, m | V, m/sec | ΔP, kg/m² | $E^2S^2L\ \Delta P/V^2$ | Contacting Efficiency |
| 2.54 | 3.87 | 56.6 | 3.64 | 84 |
| 7.62 | 7.4 | 538 | 28.8 | 97 |
| 7.62 | 5.91 | 412 | 34.4 | 98 |
| 7.62 | 3.66 | 206 | 45. | 99 |

Because of the random arrangement of the bundles constituting the bed here, it was not possible to calculate the E and S values precisely with due allowance for the effect of yarn-to-yarn contact and channel configuration Nevertheless, from the pressure drop observed, it appears that a connection of at least about 25% would be appropriate for both of these functions.

EXAMPLE 6

In this example, a quantity of catalyst pellets containing 0.35 weight percent platinum were used. These were in the form of 0.32 cm diameter solid cylinders, 0.32 cm long. The void fraction (E) was 0.3 and surface area (S) was 1.25 m²/liter. Both were determined by measuring the packed density of the pellets.

Again, because of the random arrangement of the pellets, it was not possible to calculate values of E and S with precise allowance for the effect of channel configuration. Data for operation in accordance with the conditions of Example 1 are given in the table below.

TABLE 6

| E = 0.3 S = 1.25 m²/liter | | | | |
|---|---|---|---|---|
| L, cm | V, m/sec | ΔP, kg/m² | $E^2S^2L\ \Delta P/V^2$ | Contacting Efficiency |
| 1.59 | 2.56 | 294 | 10.0 | 74 |
| 1.59 | 1.31 | 104 | 13.5 | 82 |
| 2.54 | 2.56 | 422 | 23. | 92 |
| 5.08 | 2.56 | 685 | 37.8 | 95 |

I claim:

1. An apparatus for contacting non-condensing vapors with the surface of solids comprising a process vessel having vapor inlet and outlet means at opposite ends of a fixed foraminous bed of solids, in which the void volume fraction (E) of the bed is from 0.3 to 0.98, the surface area (S) of the foraminous solids is from 0.15 to 5 m²/liter and the length (L) of the bed is from 0.03 to 3.5 m, the bed being further characterized in that, when the velocity (V) of vapors therethrough is 0.1 to 35 m/sec, the value of the relationship $$\frac{E^2S^2L\Delta P}{V^2}$$

is at least 1, but not more than 100.

2. The apparatus of claim 1 in which S is from 0.5 to 3 m²/liter.

3. The apparatus of claim 1 in which E is from 0.4 to 0.9.

4. The apparatus of claim 3 in which the foramina are derived from particulate solids in which E is from 0.4 to 0.6.

5. The apparatus of claim 3 in which the foramina are derived from monolithic solid structures in which E is from 0.5 to 0.75.

6. A method for contacting non-condensing vapors with the surface of solids comprising passing the vapors at a velocity (V) of 0.1 to 35 m/sec through a process vessel having vapor inlet and outlet means at opposite ends of a fixed foraminous bed of solids, the bed being further characterized in that the void volume fraction (E) of the bed is from 0.3 to 0.98, the surface area (S) of the foraminous solids is from 0.15 to 5 m²/liter, the length (L) of the bed is from 0.03 to 3.5 m and the relationship $$\frac{E^2S^2L\Delta P}{V^2}$$

is at leasst 1, but not more than 100.

* * * * *